US005271163A

United States Patent [19]

Pikus et al.

[11] Patent Number: 5,271,163

[45] Date of Patent: Dec. 21, 1993

[54] SYSTEM FOR TREATING FLOWABLE MATERIALS

[75] Inventors: Ilya Pikus, Plymouth; Masayuki Inoue, Brooklyn Center, both of Minn.

[73] Assignee: Bepex Corporation, Minneapolis, Minn.

[21] Appl. No.: 956,784

[22] Filed: Oct. 5, 1992

[51] Int. Cl.[5] ..... F26B 3/00

[52] U.S. Cl. ..... 34/33; 34/181

[58] Field of Search ..... 34/181, 182, 183, 180, 34/33, 22; 366/316

[56] References Cited

U.S. PATENT DOCUMENTS

| | | | |
|---|---|---|---|
| 3,425,135 | 2/1969 | Langsetmo et al. | 34/8 |
| 3,889,391 | 6/1975 | Malcolm | 34/182 X |
| 4,589,215 | 5/1986 | Iasaki et al. | 34/182 |
| 4,658,891 | 4/1987 | Wurtz | 34/182 |

*Primary Examiner*—Henry A. Bennet
*Attorney, Agent, or Firm*—James P. Ryther

[57] ABSTRACT

A system for treating flowable materials wherein an elongated cylindrical housing is provided with an inlet for introducing material to the housing at one end thereof. An inner wall surface is defined by the housing and the temperature of the inner wall surface is controlled for heat exchange between the material and the surface. An outlet for the material is provided at the other end of the housing, and an agitator extends within, and at least partially along the length of, the housing for rotation within the housing. The agitator comprises a plurality of paddles extending from adjacent the axis of rotation of the agitator toward the inner wall surface, the paddles being positioned in spaced apart locations over at least a portion of the length of the inner wall surface whereby rotation of the agitator results in the moving of the material around the inner wall surface and the propelling of the material from the inlet to the outlet. A plurality of nozzles are associated with the agitator, and gas is supplied to the nozzles and directed from the nozzles into contact with the material. This action serves to spread the material over the inner wall surface for thereby maximizing the extent of contact between the material and the surface, and for otherwise maximizing the efficiency of the material treatment.

36 Claims, 4 Drawing Sheets

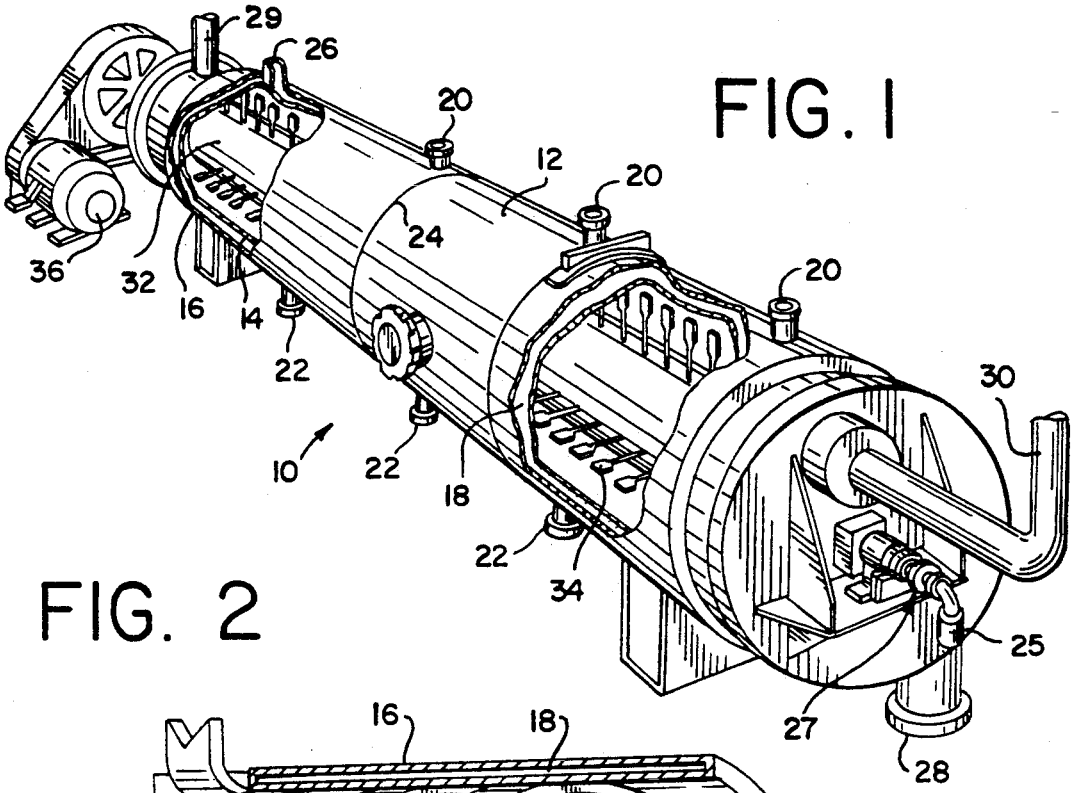
FIG. 1
FIG. 2
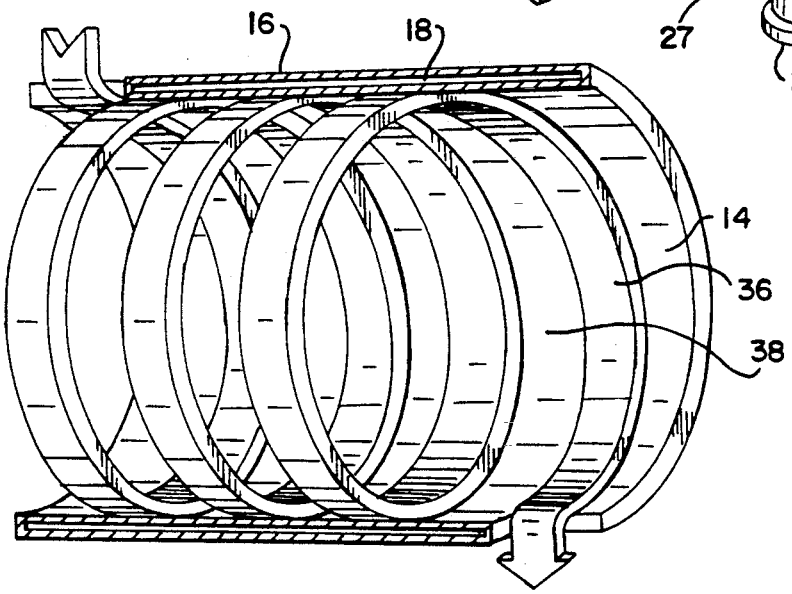
FIG. 3
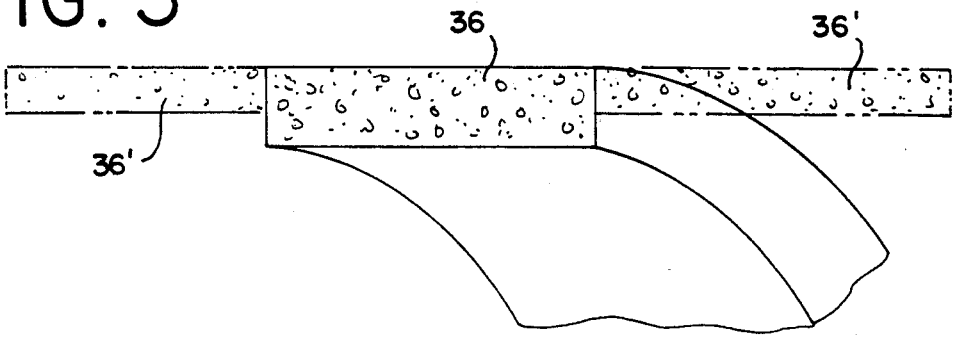

SYSTEM FOR TREATING FLOWABLE MATERIALS

BACKGROUND OF THE INVENTION

This invention relates to a system for treating material, for example, in the course of drying, heating, cooling, reacting and recrystallizing material. In particular, the invention comprises a method and apparatus for handling flowable material whereby the material can be treated in some fashion in the course of its progression through the apparatus.

The invention comprises an apparatus and method which may be implemented utilizing components of an apparatus of the type generally described in U.S. Pat. No. 3,425,135. This apparatus consists of an elongated vessel of substantially circular cross section having an axially mounted rotatable shaft disposed therein. A plurality of paddles or vanes are mounted on the rotatable shaft, and these extend substantially to the inside wall of the vessel. Typically, the vessel is disposed either horizontally or having a modest upward or downward inclination with respect to the horizontal from the material inlet end of the apparatus to the outlet thereof.

As described in the aforementioned patent, the cylindrical housing comprising the vessel is desirably jacketed to permit the circulation of heating or cooling medium adjacent the inside wall of the vessel. By introducing flowable material at one end of the vessel, treatment of the material is achieved through heat exchange between the material and the inside wall. The flowable material may comprise, for example, wet or dry solids, slurries, gels or wet cakes from filters and centrifuges.

As further described in the aforementioned patent, the paddles utilized in the system tend to propel the material in a spiral or helical path between the material inlet and outlet. As illustrated in the patent, the paddles generate a thin dense layer of material in a form of a ribbon-type flat spiral moving around the inner surface of the housing. In this way, only part of the heat transfer surface area available is covered by the material being treated. The centrifugal action of the rotating agitator decreases the mixing between particles in the dense layer of material thus reducing the heat and mass transfer rate.

SUMMARY OF THE INVENTION

This invention deals with a method and apparatus for treating flowable material wherein an elongated cylindrical housing is provided with an inlet for introducing material to the housing at one end thereof. The elongated cylindrical housing will typically comprise a vessel of the type described in the aforementioned U.S. Pat. No. 3,425,135. As set forth in that disclosure, an agitator is provided for rotation within the housing. The agitator includes a plurality of paddles which extend from the periphery of the agitator adjacent its axis of rotation and then outwardly toward the inner wall surface of the cylindrical housing.

The vessel is jacketed so that heating or cooling medium may be circulated adjacent the inner wall surface. As set forth in the prior patent disclosure, different sections of a vessel, or vessels connected in series, could be maintained at different temperature to provide differing treatments for material introduced to the vessel or vessels.

A plurality of nozzles are associated with the agitator along with the plurality of paddles. These nozzles are adapted to direct streams of fluid such as gas or liquid or combinations thereof. Preferably air is employed, for economic reasons, and where no adverse reaction with the material would result.

The gas, vapor or other fluid is directed into contact with the material disposed on the inner wall surface of the vessel. The turbulence imparted by the streams of gas will serve to spread the material over a broader surface area of the inner wall and will achieve better mixing action thereby maximizing the efficiency of the heat exchange between the inner wall surface and the material.

Nozzles which are formed independently of the paddles may extend outwardly from adjacent the axis of rotation of the agitator. In that regard, the agitator is preferably a tubular member which supports the paddles and nozzles while also providing a means for the passage of gas to the nozzles from sources located outside the housing.

Alternatively, the nozzle means for directing gas against the material may be formed integrally with the paddles. Such paddles would also preferably be in communication with a tubular agitator with gas issuing from nozzle openings defined by at least some of the paddles mounted on the agitator. The paddles are preferably configured to issue gas streams in specific directions relative to the direction of rotation of the agitator. More particularly, it has been found that a more efficient arrangement is achieved where the direction of the gas streams is opposite the propelling direction which the paddles impart to the material.

BRIEF DESCRIPTION OF THE DRAWINGS

FIG. 1 is a perspective view of a rotary solids processing apparatus useful for practicing the concepts of this invention;

FIG. 2 is a schematic perspective view illustrating the configuration of material flow when utilizing the prior art apparatus of the type shown in FIG. 1;

FIG. 3 is an enlarged schematic illustration illustrating modified material flow which can be achieved with the concepts of this invention;

DETAILED DESCRIPTION OF THE DRAWINGS

Figure 4:
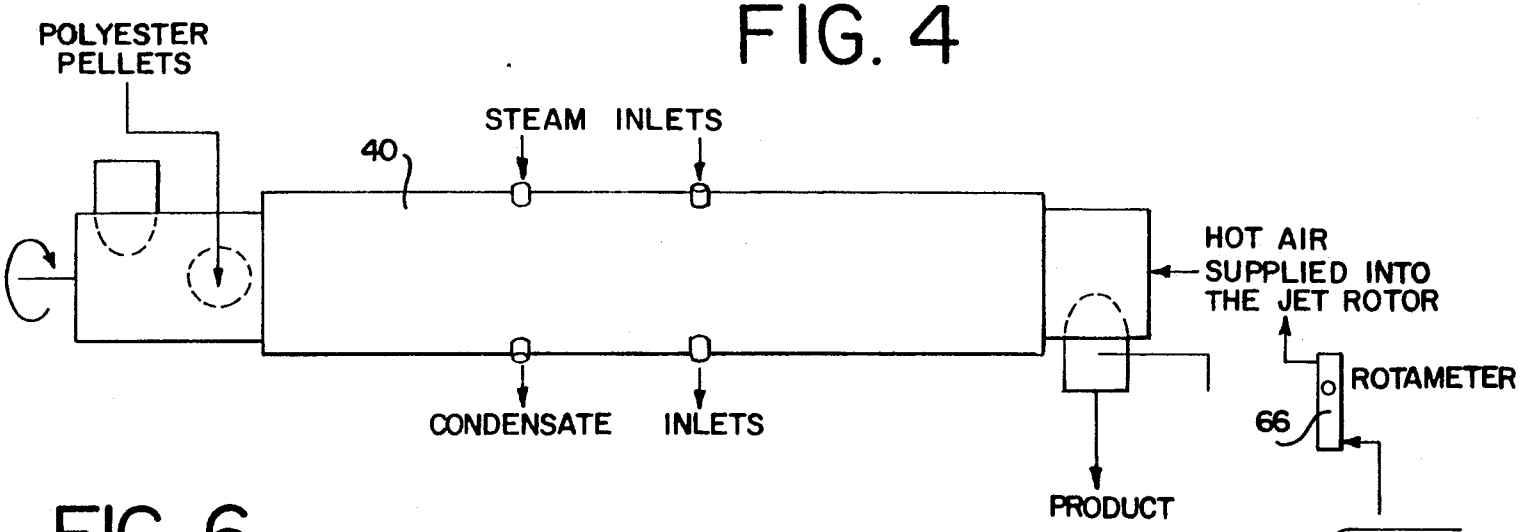
FIG. 4 is a diagrammatic illustration of a typical operation in accordance with the concepts of this invention.

FIG. 1 illustrates an apparatus 10 which includes an elongated cylindrical housing 12. This housing defines an inner wall 14 and an outer wall 16 whereby passages 18 are defined between the vessel walls. Thus, the outer wall 16 constitutes a spaced-apart jacket for the inner wall 14. Inlet fittings 20 are associated with the outer jacket whereby steam or other media may be introduced into the passages 18 defined between the inner and outer walls. Outlet fittings 22 are provided whereby condensate or other media may be removed and whereby constant circulation around the inner wall of the vessel can be achieved.

As shown in FIG. 1, a parting line 24 may be defined between vessel sections so that one section may be maintained at a different temperature level than another section. More than two such sections are contemplated, and it is also contemplated that material exiting from the vessel shown in FIG. 1 may be passed to an adjacent vessel for continued treatment.

Material is introduced to the vessel 12 through inlet 26 and a material outlet 28 is provided at the opposite end of the vessel. As described in the aforementioned patent, it is contemplated that heated gas may be introduced with the material for circulation through the vessel. Under such circumstances, the gas may be introduced through inlet 26 or a separate inlet 29, and a discharge pipe 30 for vapor discharge is provided. This arrangement will result in gases flowing across the vessel and cocurrent with the material.

Alternatively, the pipe 30 may be employed for the introduction of gases which will move countercurrent to the material and the separate pipe 29 may be employed for vapor discharge or this discharge may occur through inlet 26. This arrangement results in "countercurrent" flow.

An agitator consisting of tubular rotor 32 and rows of paddles 34 is mounted for rotation within the vessel 12, and motor 36 is employed for driving the rotor. As explained in the aforementioned patent, the paddles extend outwardly from the rotor surface which is adjacent the axis of rotation of the rotor. The paddles extend to a point closely adjacent the inner surface of inner wall 14 whereby the paddles will serve to propel material from the inlet of the vessel along the length of the vessel and to the outlet of the vessel.

FIG. 2 illustrate the configuration assumed by material 36 as it is propelled through an apparatus as shown in FIG. 1 and described in the aforementioned patent. Thus, the paddles mounted on the rotating agitator serve to impart centrifugal force to the material whereby the material tends to be pressed against the inner wall 14. In addition, the paddles impart a spiral or helical configuration to the material whereby the great majority of material tends to occupy specific areas of the inner wall while other areas 38 of the inner wall are not covered by material to any significant degree. As will be explained in greater detail, the concepts of this invention tend to spread the material 36 over a wider surface area particularly as shown at 36' in FIG. 3.

Figure 5:
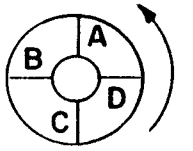
FIG. 5 is a diagrammatic view illustrating the agitator rotation for a system incorporating the features of the invention.
Figure 6:
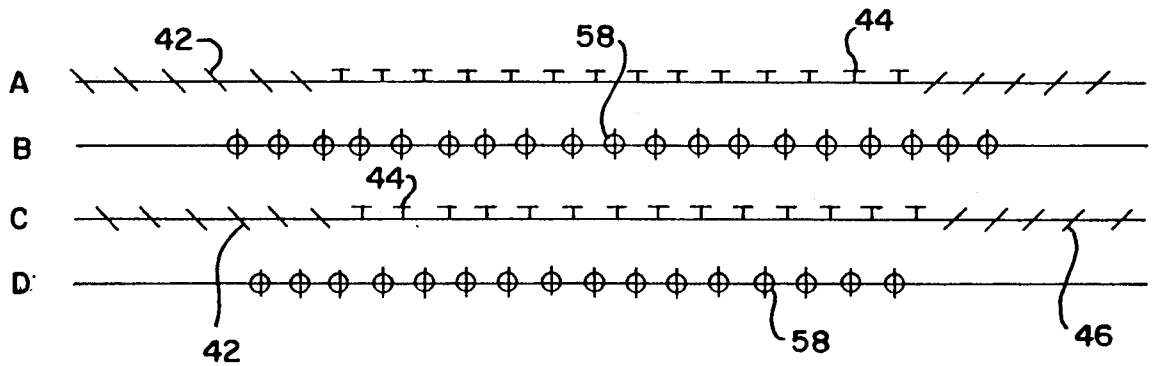
FIG. 6 is a diagrammatic illustration of an example of paddle and nozzle attitudes which may be assumed when practicing the invention.

FIGS. 4, 5 and 6 illustrate an example of the application of this invention. In this instance, polyester pellets are being introduced to vessel 40 for purposes of crystallizing the polyester. Heat is provided by means of steam introduced through inlets communicating with the space provided by the jacketed vessel design and an agitator assembly comprising a rotor and paddles is employed for propelling the pellets through the vessel. As shown in FIGS. 5 and 6, the paddles and nozzles are arranged in lines extending longitudinally of the housing. The lines comprise two lines of paddles, A and C, and two lines of nozzles, B and D. Thus, in this example, rows of nozzles are substituted for two of the rows of paddles shown in FIG. 1.

The paddles can be adjusted for achieving a particular operation. As shown, the lines of paddles A and C include paddles 42 which are positioned at a 45 degree angle, and adjacent paddles 44 which are positioned with their long dimension parallel with the axis of the rotor. Finally, paddles 46 are positioned at a 45 degree angle, but in an attitude opposite the paddles 42.

The lines of nozzles B and D are positioned at 90° intervals on the rotor relative to the lines of paddles. The nozzle positions in a given line are shown staggered with respect to the paddles in an adjacent line, preferably positioned at midpoints between paddles.

Figure 7:
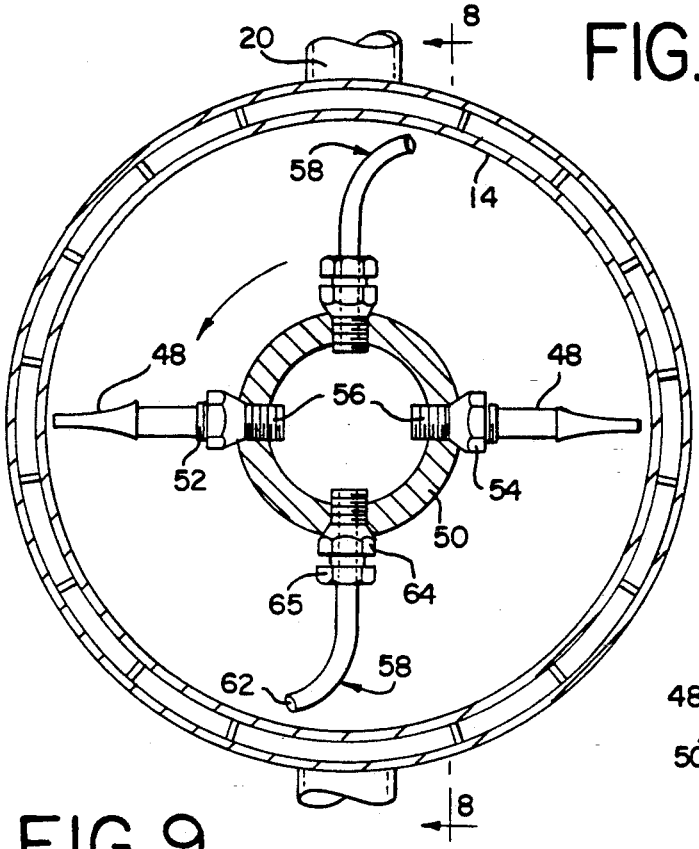
FIG. 7 is a cross-sectional view of a vessel employed for the practice of the invention viewed from the inlet end.
Figure 9:
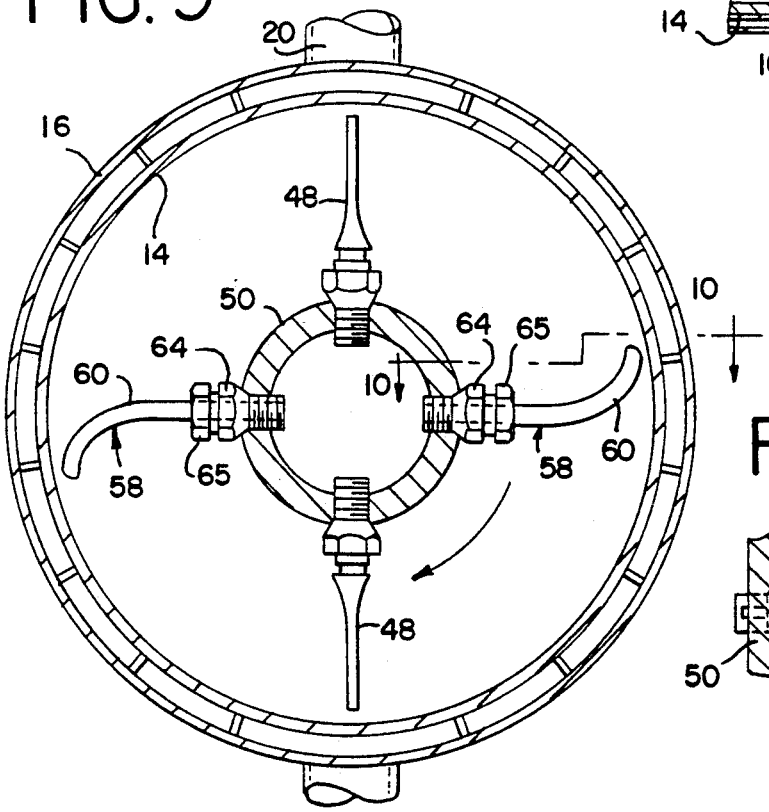
FIG. 9 is a cross-sectional view of a vessel employed for the practice of the invention viewed from the outlet end.

FIGS. 7 and 9 illustrate paddles 48 mounted on tubular rotor 50. These paddles are positioned in accordance with paddles 44 in lines A and C of FIG. 6. The paddles 48 include threaded ends 52 which are received and adjustably supported on nuts 54. These nuts have an integrally formed threaded shaft portion 56 which permits rotation of the nuts relative to the rotor 50 for thereby adjusting the attitude of paddles 48.

The paddles 48 are adapted to be located in diametrically opposite lines extending along the length of rotor 50. Nozzles 58 are in turn located in a pair of lines 90 degrees offset from the paddles. Each of these nozzles includes a pipe section 60 terminating in open end 62. The adjustable nuts 64 and collars 65 support these pipe sections thereby permitting adjustment of the attitudes of the nozzles.

Gas is adapted to be delivered to the rotor 50 for passage outwardly through the nozzles 58. As schematically illustrated in FIG. 4 and as shown in FIG. 1, the gas may comprise hot air supplied to the rotor through pipe 25 leading to rotary joint 27. A rotameter 66 is provided for measuring the air flow rate. An electric heater or other type of air heater 68 may be utilized as the means for heating the air prior to injection into the rotor.

With the arrangement of FIGS. 7 and 9, a system such as shown in FIG. 4 may be implemented. Thus, where crystallization of the polyester pellets constitutes the intended application of the invention, steam is used for heating the inner wall surface with additional heat being provided by the hot air injected into the rotor. In that connection, the hot air issuing from nozzles 58 will influence the heat transfer and, in addition, the rotor itself will be heated by the hot air and thereby supply additional heat within the cylindrical housing by convection.

Figure 8:
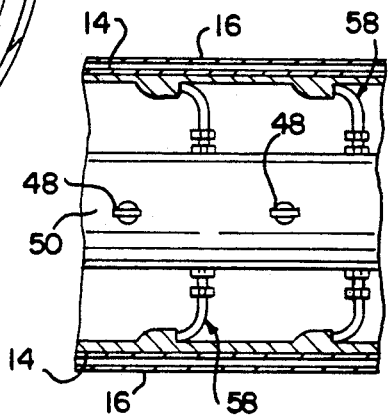
FIG. 8 is a reduced fragmentary sectional view of the vessel taken about the line 8—8 of FIG. 7.
Figure 10:
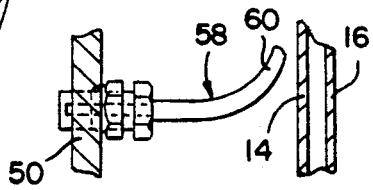
FIG. 10 is a fragmentary view of the vessel taken about the line 10—10 of FIG. 9.

In FIG. 8, the nozzles 58 are longitudinally displaced with respect to paddles 48 rather than being located at the same longitudinal positions as shown in FIGS. 7 and 9. FIGS. 8 and 10 also illustrate the fact that the attitude of the nozzles is preferably such that air or other gas will issue from the nozzles in a direction opposite the propelling direction of the material by the paddles. This attitude of the nozzles relative to the propelled direction of movement of the material is most effective from the standpoint of distributing the material over the inner wall of the cylindrical housing, and is effective as a means for controlling the hold-up or residence time of material in the unit.

Figure 11:
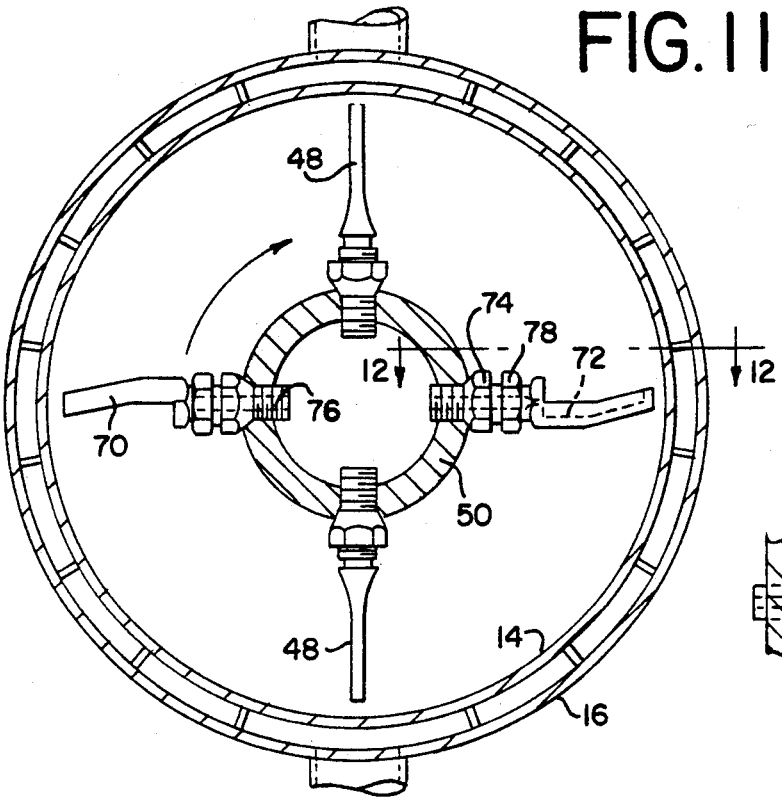
FIG. 11 is a cross-sectional view of the vessel illustrating a modified form of paddle means with associated nozzles.
Figure 12:
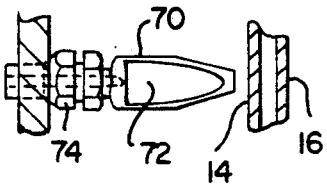
FIG. 12 is a fragmentary view of the vessel taken about the line 12—12 of FIG. 11.

FIGS. 11 and 12 illustrate a modified form of nozzle for use in the practice of the invention. In this instance, lines of paddles 48 may be mounted on the rotor 50 in the manner shown in FIGS. 7 and 9. Additional paddles 70 are provided with each paddle including a recessed central section 72. The stem portion of each paddle 70 is received by a nut 74 which carries a threaded portion 76 adjustably received by rotor 50. A collar 78 serves to secure the paddle in place relative to the nut 74 after a desired attitude of the paddle is achieved.

Communicating passages are defined through nut 74 and the paddle stem portion whereby air or other gas will issue at the base of paddle 70 and then be directed at the material being treated. As shown in FIG. 11, the recessed portion 72 of the paddle 70 is inclined so that the air will be directed against the material in a direction opposite the propelling direction imparted to the material by the paddles.

Figure 13:
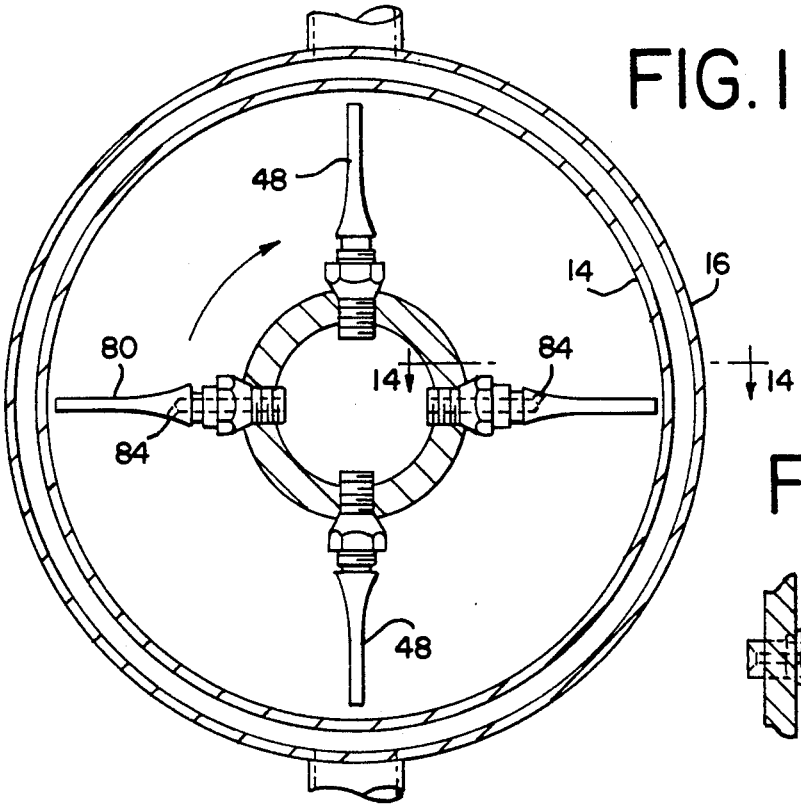
FIG. 13 is a cross-sectional view of the vessel illustrating a further modified view of nozzle and paddle means; and, FIG. 14 is a fragmentary view of the vessel taken about the line 14—14 of FIG. 13.
Figure 14:
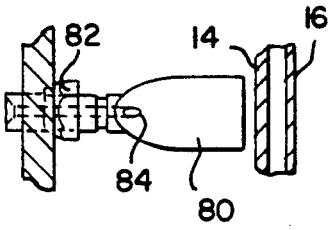

FIGS. 13 and 14 illustrate an additional modified form of the invention. In this case, lines of paddles 48 are also mounted on the rotor 50. Paddles 80 are positioned intermediate the paddles 48, and these paddles include stem portions received in nuts 82. Passages defined by the stem portions and nuts permit passage of air from within rotor 50 outwardly through openings 84 defined by the paddles 80. The passages and associated openings are defined so that the air may be directed opposite the propelling direction of the paddles in accordance with the preferred form of the invention.

As will be apparent from the foregoing description, various configurations of paddles and nozzle means may be employed. The location and number of these components and the attitudes assumed can be readily adjusted depending upon the intended treatment and the nature of the material being treated. Four lines of paddles and nozzles have been shown, but variations are contemplated. For example, four lines of nozzles could be interposed between the paddles or rotor 32 of FIG. 1 with a total of eight lines of nozzles and paddles then being utilized. Similarly, the staggering of paddles and nozzles as shown in FIGS. 5, 6 and 8 is contemplated for the arrangements of FIGS. 7, 9, 11 and 13.

It has been found that a system in accordance with this invention is especially suitable for treating of high heat sensitive materials. This is particularly due to the high heat transfer efficiency which is achieved due to the action of the nozzle means on the material layer being propelled through the system. The system thus provides for an increase in the inner wall surface area in contact with the material and corresponding improved heat transfer. The invention also provides for the additional heating or cooling which is imparted by the air or other gas issuing from the nozzles. Still further thermal control is achieved by the introduction of hot or cold air or other gas into the rotor.

The system, for example when used as a dryer, also provides for higher efficiency because of the mixing action achieved by the nozzle means. Another beneficial result is that lower mean vapor partial pressure is achieved in the air purged bed due to the removal of vaporized reaction products in the course of the operation of the system.

The system provides these further advantages with respect to the introduction of gas through the material inlet for cocurrent flow or for the introduction of gas at the opposite end of the system for countercurrent flow.

It is also noteworthy that the system combines the advantages of the indirect heat supply concept of the prior art with the advantages of cross-flow heat and mass transfer patterns, and with material being exposed to continuous sources of heat at a constant temperature in a system operating at maximum efficiency. Shortcomings of existing systems may be decreased or eliminated since:

1. With a cross-cocurrent flow pattern:
   a. The residence time can be increased and controlled by optimization of the gas flow distribution along the dryer; accordingly, the particles classification may be reduced; and,
   b. Cross-flow concepts improve the dryer heat efficiency (due to lower exhaust gas temperatures) and make it possible to dry material to a lower moisture content; and,
2. With a cross-countercurrent flow pattern:
   a. The system is especially useful for temperature sensitive materials;
   b. The unproductive internal recycle of condensable volatiles and fine particles can be reduced; and,
   c. The exhausted gas temperature and humidity may be controlled, therefore preventing condensation in the bag filter.

The system also provides controls to insure optimum product and air velocity as well as optimum temperature in the dryer. Such controls lead to improved product quality.

The system also provides controls to insure optimum product and air velocity as well as optimum temperature in the dryer. Such controls lead to improved product quality.

The use of the nozzle means described imparts turbulence and local fluidization to the bed and reduces the degree of mechanical agitation which must otherwise be achieved by high speed rotation of the paddle rotor. The enhanced bed porosity along with possible reduction of the rotor speed are accompanied by the following positive results:

1. reduced particle attrition and fines generation;
2. decreased abrasive wear of machine;
3. lower rotor drive horsepower; and
4. reduced heat generated by rotating rotor which is very important where a cooling application is contemplated.

As noted, the system of the invention permits selective use of the nozzle means, that is, the temperature and pressure of gas issuing from nozzle means may differ from one section to another. This local temperature control in the work areas may be employed to prevent, for instance, wax fouling (using local high temperature jet blasts) or particle sintering (using relatively low temperature jet blasts). Jet blasts could also be used as an aerodynamical curtain in the drying chamber to separate, for instance, the drying zone from the cooling zone.

In drying extremely high heat sensitive materials, a temperature oscillating drying process may be realized by using low temperature jet blasts in combination with a high inner wall surface temperature or vice versa. The nozzles may also be used to provide gaseous or liquid agents as additions or reaction agents in any zone of the bed of material being processed (for stripping, coating, etc.). For example, steam introduced with air may be employed in a process intended to strip methanol from a polymer and substitute water. In animal feed processing, a liquid binder comprising molasses may be added through the nozzles as an addition to soy bean meal.

For thermoprocessing of some fragile materials, the nozzle means, such as the nozzles 58 of FIG. 7, may be utilized using a minimum number of paddles, preferably at the feeding end only for achieving sufficient propelling action, so that for the majority of the time, the material is subject to agitation by jet blasts only.

It will be understood that various changes and modifications may be made in the concepts of the invention described without departing from the spirit of the invention particularly as defined in the following claims.

We claim:

1. An apparatus for treating flowable materials including an elongated cylindrical housing, an inlet for introducing material to said housing at one end thereof, an inner wall surface defined by said housing, means for controlling the temperature of said inner wall surface for heat exchange between said material and said surface, an outlet for said material at the other end of said housing, an agitator extending within and at least partially along the length of said housing and mounted for rotation within said housing, said agitator comprising a plurality of paddles extending from adjacent the axis of rotation of the agitator toward said inner wall surface, said paddles being positioned in spaced apart locations over at least a portion of the length of said inner wall surface, rotation of said agitator resulting in the movement of said material around said surface and the propelling of said material from said inlet to said outlet, and including a plurality of nozzle means associated with said agitator, said agitator comprising an axially positioned rotor for supporting said paddles and nozzle means, gas passage means within said rotor, means for introducing gas into said rotor, means for supplying gas through the rotor to said nozzle means, and means for directing gas from said nozzle means into contact with said material for spreading of the material over said surface and for thereby maximizing the extent of contact between said material and said surface and the efficiency of the material treatment.

2. An apparatus according to claim 1 wherein said paddles extend in at least one line between said inlet and outlet, and wherein said nozzle means extend in at least one separate line between said inlet and outlet.

3. An apparatus according to claim 2 wherein lines of paddles are positioned diametrically opposite each other, and wherein said nozzle means are positioned in lines spaced from said lines of paddles.

4. An apparatus according to claim 2 wherein said nozzle means are offset longitudinally with respect to said paddles.

5. An apparatus according to claim 1 wherein said nozzle means direct said gas in a direction opposing the propelling direction of said paddles.

6. An apparatus according to claim 5 wherein said nozzle means direct said gas at an angle relative to the propelling direction of said paddles, said angle being between 90 degrees and 180 degrees opposite the propelling direction.

7. An apparatus according to claim 1 including means for controlling the temperature of the gases supplied to the rotor.

8. An apparatus according to claim 1 wherein said nozzle means are tubular in shape.

9. An apparatus according to claim 1 wherein said nozzle means are combined with at least some of said paddles.

10. An apparatus according to claim 9 wherein at least some paddles each define a passage for said gas which opens into said housing at the base of the paddle, said passage being configured to direct the gas in a direction opposite the propelling direction of said paddles.

11. An apparatus according to claim 9 wherein at least some paddles define a passage for said gas which opens into said housing at the base of the paddle, said paddles being configured to direct the gas in a direction opposite the propelling direction of said paddles.

12. An apparatus according to claim 9 wherein the attitude of said paddles is adjustable relative to the propelling direction, and wherein adjustment of the paddles changes the direction of gas issuing from the nozzle means.

13. An apparatus according to claim 7 wherein heat exchange and mass transfer occurs between said rotor and the interior of said housing.

14. A method for treating flowable material wherein the material is introduced into an elongated cylindrical housing having an inlet for the material at one end thereof, an inner wall surface defined by said housing, controlling the temperature of said inner wall surface for heat exchange between said material and said surface, discharging the material through an outlet at the other end of said housing, providing an axially rotatable agitator extending within and at least partially along the length of said housing and rotating said agitator within said housing, said agitator comprising a plurality of paddles extending from adjacent the axis of rotation of the agitator toward said inner wall surface, positioning said paddles in spaced apart locations over at least a portion of the length of said inner wall surface, moving said material around said surface and propelling said material from said inlet to said outlet by means of agitator rotation, associating a plurality of nozzle means with said agitator, locating said paddles in at least one line between said inlet and outlet, and positioning said nozzle means to extend in at least one separate line between said inlet and outlet, offsetting said nozzle means longitudinally with respect to said paddles, supplying gas to said nozzle means, and directing said gas from said nozzle means into contact with said material for spreading of the material over said surface and for thereby maximizing the extent of contact between said material and said surface and the efficiency of the material treatment.

15. A method according to claim 14 including locating a number of lines of paddles diametrically opposite each other, and locating said nozzle means in a number of lines spaced from said lines of paddles.

16. A method according to claim 14 including directing said gas from said nozzle means in a direction opposing the propelling direction of said paddles.

17. A method according to claim 16 including directing said gas at an angle relative to the propelling direction of said paddles, said angle being between 90 degrees and 180 degrees opposite the propelling direction.

18. A method for treating flowable material wherein the material is introduced into an elongated cylindrical housing having an inlet for the material at one end thereof, an inner wall surface defined by said housing, controlling the temperature of said inner wall surface for heat exchange between said material and said surface, discharging the material through an outlet at the other end of said housing, providing an axially rotatable agitator extending within and at least partially along the length of said housing and rotating said agitator within said housing, said agitator comprising a plurality of paddles extending from adjacent the axis of rotation of the agitator toward said inner wall surface, positioning said paddles in spaced apart locations over at least a portion of the length of said inner wall surface, moving said material around said surface and propelling said material from said inlet to said outlet by means of agitator rotation, associating a plurality of nozzle means with said agitator, said agitator comprising an axially positioned rotor means, supporting said paddles and nozzles on said rotor means, introducing fluid into said rotor means and thereby supplying fluid to said nozzle means into contact with said material for spreading of the material over said surface and for thereby maximizing the extent of contact between said material and said surface and the efficiency of the material treatment.

19. A method according to claim 14 including combining said nozzle means with at least some of said paddles.

20. A method according to claim 19 including forming a passage for said gas which opens into said housing at the base of each of said at least some paddles, said passages being configured to direct the gas in a direction opposite the propelling direction of said paddles.

21. A method according to claim 19 including forming a passage for said gas which opens into said housing at the base of said at least some paddles, said passages being configured to direct the gas in a direction opposite the propelling direction of said paddles.

22. A method according to claim 19 including the step of adjusting the attitude of said paddles relative to the propelling direction, the adjustment of the paddles adjusting the direction of gas streams issuing from the nozzle means.

23. A method according to claim 21 including controlling the temperature of the gases supplied to the rotor.

24. An apparatus for treating flowable material including an elongated cylindrical housing, an inlet for introducing material to said housing at one end thereof, an inner wall surface defined by said housing, means for controlling the temperature of said inner wall surface for heat exchange between said material and said surface, an outlet for said material at the other end of said housing, an agitator extending within and at least partially along the length of said housing and mounted for rotation within said housing, said agitator comprising a plurality of propelling means extending from adjacent the axis of rotation of the agitator toward said inner wall surface, said propelling means being positioned in spaced apart locations over at least a portion of the length of said inner wall surface, rotation of said agitator resulting in the movement of said material around said surface and the propelling of said material from said inlet to said outlet, and wherein at least some of said propelling means comprise nozzle means, and means for directing gas from said nozzle means into contact with said material for spreading of the material over said surface and for thereby maximizing the extent of contact between said material and said surface and the efficiency of material treatment.

25. A method according to claim 23 including the step of providing heat exchange and mass transfer between said rotor and the interior of said housing.

26. A method according to claim 18 wherein said fluid is selected from the group consisting of liquid, gas, or a combination of liquid and gas.

27. An apparatus for treating flowable materials including an elongated cylindrical housing, an inlet for introducing material to said housing at one end thereof, an inner wall surface defined by said housing, means for controlling the temperature of said inner wall surface for heat exchange between said material and said surface, an outlet for said material at the other end of said housing, an agitator extending within and at least partially along the length of said housing and mounted for rotation within said housing, said agitator comprising a plurality of paddles extending from adjacent the axis of rotation of the agitator toward said inner wall surface, said paddles being positioned in spaced apart locations over at least a portion of the length of said inner wall surface, rotation of said agitator resulting in the movement of said material around said surface and the propelling of said material from said inlet to said outlet, and including a plurality of nozzle means associated with said agitator, said nozzle means being combined with at least some of said paddles, and means for directing gas from said nozzle means into contact with said material for spreading of the material over said surface and for thereby maximizing the extent of contact between said material and said surface and the efficiency of the material treatment.

28. An apparatus according to claim 27 wherein at least some paddles defined a passage for said gas which opens into said housing at the base of the paddle, said passage being configured to direct the gas in a direction opposite the propelling direction of said paddles.

29. An apparatus according to claim 27 wherein at least some paddles define a passage for said gas which opens into said housing at the base of the paddle, said paddles being configured to direct the gas in a direction opposite the propelling direction of said paddles.

30. An apparatus according to claim 27 wherein the attitude of said paddles is adjustable relative to the propelling direction, and wherein adjustment of the paddles changes the direction of gas issuing from the nozzle means.

31. A method for treating flowable material wherein the material is introduced into an elongated cylindrical housing having an inlet for the material at one end thereof, an inner wall surface defined by said housing, controlling the temperature of said inner wall surface for heat exchange between said material and said surface, discharging the material through an outlet at the other end of said housing, providing an axially rotatable agitator extending within and at least partially along the length of said housing and rotating said agitator within said housing, said agitator comprising a plurality of paddles extending from adjacent the axis of rotation of the agitator toward said inner wall surface, positioning said paddles in spaced apart locations over at least a portion of the length of said inner wall surface, moving said material around said surface and propelling said material from said inlet to said outlet by means of agitator rotation, associating a plurality of nozzle means with said agitator, said agitator comprising an axially positioned rotor means, supporting said paddles and nozzles on said rotor means, introducing gas into said rotor means and thereby supplying gas to said nozzle means, through said rotor means, and directing said gas from said nozzle means into contact with said material for spreading of the material over said surface and for thereby maximizing the extent of contact between said material and said surface and the efficiency of the material treatment.

32. A method according to claim 31 including controlling the temperature of the gases supplied to the rotor.

33. A method for treating flowable material wherein the material is introduced into an elongated cylindrical housing having an inlet for the material at one end thereof, an inner wall surface defined by said housing, controlling the temperature of said inner wall surface for heat exchange between said material and said surface, discharging the material through an outlet at the other end of said housing, providing an axially rotatable agitator extending within and at least partially along the length of said housing and rotating said agitator within said housing, said agitator comprising a plurality of paddles extending from adjacent the axis of rotation of the agitator toward said inner wall surface, positioning said paddles in spaced apart locations over at least a portion of the length of said inner wall surface, moving said material around said surface and propelling said material from said inlet to said outlet by means of agitator rotation, associating a plurality of nozzle means with said agitator, and combining said nozzle means with at least some of said paddles, supplying gas to said nozzle means, and directing said gas from said nozzle means into contact with said material for spreading of the material over said surface and for thereby maximizing the extent of contact between said material and said surface and the efficiency of the material treatment.

34. A method according to claim 33 including forming a passage for said gas which opens into said housing at the base of at least some paddles, said passages being configured to direct the gas in a direction opposite the propelling direction of said paddles.

35. A method according to claim 33 including forming a passage for said gas which opens into said housing at the base of at least some paddles, said passages being configured to direct the gas in a direction opposite the propelling direction of said paddles.

36. A method according to claim 33 including the step of adjusting the attitude of said paddles relative to the propelling direction, the adjustment of the paddles adjusting the direction of gas streams issuing from the nozzle means.

* * * * *